United States Patent [19]

Frank

[11] 4,226,166

[45] Oct. 7, 1980

[54] CONTROL UNIT FOR THE SUPPLY OF A WORK UNIT FED IN PARALLEL FROM A HYDRAULIC STATION COMMON TO OTHER UNITS

[76] Inventor: Roger F. Frank, Cluses, France, 74300

[21] Appl. No.: 877,726

[22] Filed: Feb. 14, 1978

[30] Foreign Application Priority Data

Feb. 16, 1977 [FR] France ..... 77 05166

[51] Int. Cl.[3] ..... F15B 11/16; F15B 13/06

[52] U.S. Cl. ..... 91/5; 60/403; 60/413; 91/28; 91/451; 91/454; 91/509

[58] Field of Search ..... 91/451, 5, 442, 268, 91/28, 454, 509; 137/514.5, 568, 102, 107; 60/403, 413

[56] References Cited

U.S. PATENT DOCUMENTS

| | | | |
|---|---|---|---|
| 2,888,909 | 6/1959 | Gratzmuller | 91/442 |
| 2,954,047 | 9/1960 | Faltejsek et al. | 137/514.5 X |
| 3,136,226 | 6/1964 | Gratzmuller | 91/442 |
| 3,847,180 | 11/1974 | Kroth et al. | 91/451 X |
| 3,991,570 | 11/1976 | Keller | 60/413 |
| 4,036,106 | 7/1977 | Athy, Jr. | 91/5 |

FOREIGN PATENT DOCUMENTS 7341011 6/1975 France .

*Primary Examiner*—Irwin C. Cohen
*Attorney, Agent, or Firm*—Bacon & Thomas

[57] ABSTRACT

Hydraulic control.

The unit is characterized in that it is provided, between an inlet well and an outlet well for pressurized fluid, with an obturator urged in the closed position by a resilient member arranged to act against the pressurized fluid in the inlet well in a chamber communicating with a conduit issued from the outlet well and separated from a return conduit by a relief valve which is urged in the closed position by a spring and by the fluid pressure prevailing in the inlet well.

Application to transfer-machines with one single hydraulic station.

5 Claims, 2 Drawing Figures

CONTROL UNIT FOR THE SUPPLY OF A WORK UNIT FED IN PARALLEL FROM A HYDRAULIC STATION COMMON TO OTHER UNITS

BACKGROUND AND BRIEF SUMMARY OF THE INVENTION

The present invention relates to the problems of supply of a plurality of hydraulic work units from a common power station and more particularly to the problems encountered for example in transfer-machines, comprising a plurality of work units with a fixed station, carrying out different work cycles controlled in accordance with appropriate programming from a hydraulic power supplied by a common production unit.

In the machines of the above type, it is known that it is considered as advantageous, regarding cost and operation price, to provide only one hydraulic station for supplying the various work units or stations of the same machine effecting different cycles which develop according to an appropriate programming. A concept of this type raises however a problem since, for example, when one of the work units is in fast return phase between two successive machining phases, a momentary drop of pressure occurs in the supply circuit which is common to all units. A pressure drop of this type is detrimental to the correct operation of the other units in machining phase since the hydraulic power transformers which control the tools are subject to rushes which are highly prejudicial to the quality of the work executed, in particular in the finishing stage. In some cases, these rushes may even cause breaking of fragile tools.

For solving this problem it has already been proposed to use, for each of the supply circuits suitable for a unit or a work station, a control device of the slide valve type, the respective positions of which are controlled by the pressure variations of the circuit, upstream and downstream. An apparatus of this type, even if it permits to solve the problem, has two obvious drawbacks. The first drawback is its complex design which requires a complicated and accurate machining resulting in a high cost and maintenance price. The second drawback results from the fact that it is necessary to connect the different upstream and downstream pressure sources, so that mounting such an apparatus in a conventional supply circuit substantially complicates the circuit, in particular by requiring subsidiary apparatus for its operation.

The aim of the present invention is to obviate the above drawback by solving the problem, and to this end, the invention suggests a new control unit which can be very easily adapted to the supply circuit of each work unit or station while requiring only one main direct connection and the setting up of a secondary direct feedback circuit between the said apparatus and the fluid reservoir. In addition, the subject matter of the invention is conceived in a particularly simple manner in order to be of a relatively low price and to have low maintenance costs, considering the good possibilities of access to the various movable constitutive parts which can be subjected to wear or deterioration.

According to the invention, the unit controlling the supply of a work unit fed in parallel from a hydraulic station common to other units is characterized in that it comprises, between an inlet well and an outlet well for the fluid under pressure, closure means urged into the closed position by a resilient member located in a chamber communicating with a conduit issuing from the outlet well so as to act against the pressurized fluid delivered in the inlet well and separated from a feed back conduit to a reservoir by a relief valve urged in the closed position by means of a resilient member and by the fluid pressure prevailing in the inlet well.

Other characteristics will become apparent from the following description made with reference to the accompanying drawing, which shows as a non-limitative example, an embodiment of the subject matter of the invention.

DETAILED DESCRIPTION OF THE PREFERRED EMBODIMENTS

Figure 1:
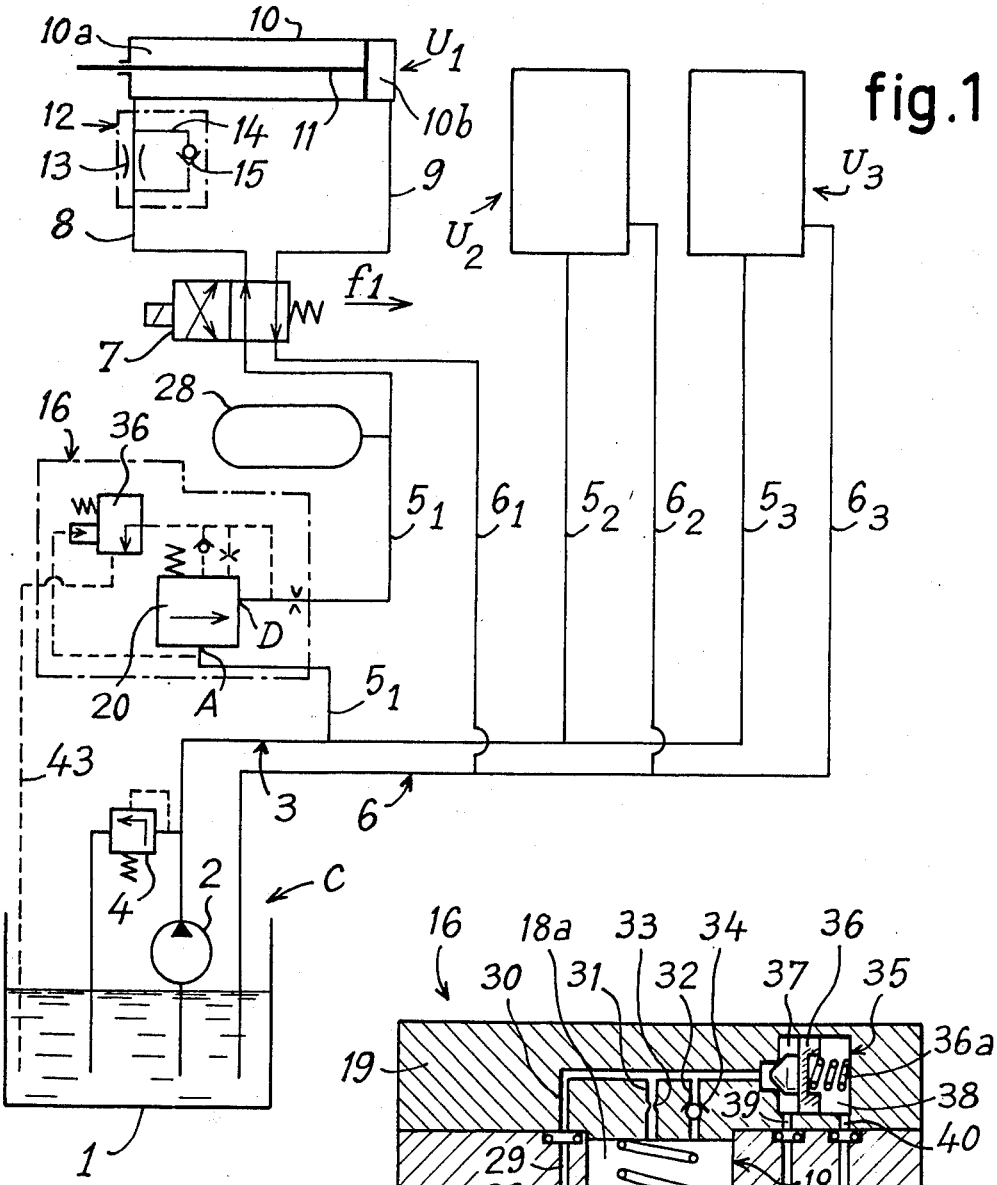
FIG. 1 is a diagram showing how to carry out the subject of the invention in a control circuit for a work unit supplied, like other units, in parallel from a common station.

FIG. 1 diagrammatically shows the hydro-electrical supply circuit for a transfer-machine comprising three separate work units $U_1$, $U_2$, $U_3$ supplied in hydro-electric power from a common station C. FIG. 1 shows the supply diagram for unit $U_1$, but it must be considered that the supply circuits of units $U_2$ and $U_3$ have the same characteristics, which are the subject of the invention.

The common unit C is provided with a reservoir 1 which supplies a pump 2 whose delivery circuit 3 is for example associated with a pressure control valve 4. The delivery circuit 3 communicates with three supply circuits $5_1$, $5_2$, $5_3$ leading to units $U_1$, $U_2$, $U_3$ which are also connected in parallel to a feedback return conduit 6 by individual connections $6_1$, $6_2$ and $6_3$.

As specified above, each supply circuit $5_1$, $5_2$ and $5_3$ has the same characteristics of construction, and for this reason, only the supply circuit of unit U will be described hereinafter.

Supply conduit $5_1$ ends in a two-position electric distributor 7, to which is also connected the feedback connection $6_1$. The electric distributor is of the four-input type and is connected by two conduits 8 and 9 to the two chambers 10*a*–10*b* of a hydraulic energy transformer 10, for example consisting of a double-acting jack whose rod controls the motion of a work tool, not shown.

Conduit 8, feeding chamber 10*a* of jack 10 corresponding to the quick feed-back control of the tool carried by rod 11, is provided with a flow regulator 12 comprising a diaphragm 13 and a derivation circuit 14 on which is placed a no-return valve in the direction jack 10, distributor 7.

Figure 2:
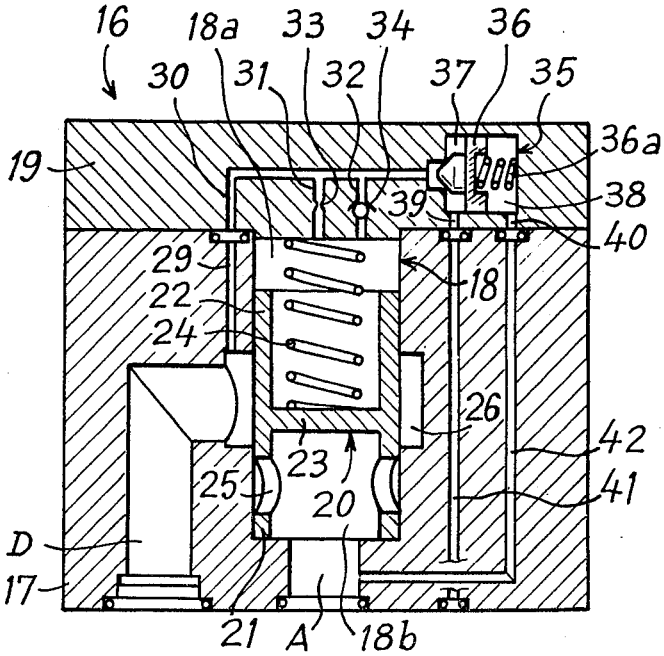
FIG. 2 is a sectional view in elevation illustrating an embodiment of the subject of the invention.

According to the invention, the supply circuit $5_1$ is controlled, between the distributor 7 and the delivery circuit 3, by a control unit 16 which comprises, as shown in FIG. 2, a main body 17 defining a cylinder 18 which can be connected to the supply circuit $5_1$ by means of an inlet well A. Cylinder 18 is closed at the level of the face of body 17 opposite to well A by a secondary removable member 19 mounted in a sealed manner on body 17.

Cylinder 18 contains a closure means formed by a sliding piston 20 comprising two cylindrical skirts 21 and 22 placed on each side of a base 23 defining in the cylinder two opposite chambers 18*a* and 18*b* with a variable volume. Chamber 18*b* communicates with well A while chamber 18*a* contains a spring 24 placed under compression to urge skirt 21 in abutment against the bottom of cylinder 18. Skirt 21 has two diametrically opposed vents 25 whose cross-section is at the most equal to the height of a counterboring 26 made in the body 17, starting from the wall of the median part of cylinder 18. Counterboring 26 communicates with an outlet well D connected to the portion of the supply 5 which leads to the distributor 7 and on which is connected in parallel a hydraulic accumulator 28.

Counterboring 26 also communicates with a drilling 29 of the main body 17 so as to communicate with a conduit 30 provided in the secondary member 19. Conduit 30 communicates with two holes 31 and 32 issuing in chamber 18*a* of cylinder 18 and which are respectively controlled by a restrainer 33 and by a no-return valve 34 in the direction in which flows the hydraulic fluid coming from cylinder 18. Conduit 30 also ends in a recess 35 provided in the secondary member 19 to constitute the chamber of a relief valve 36 dividing said chamber into two variable volume capacities 37 and 38. Valve 36 is urged by a resilient member 36*a* in the direction for which it closes the orifice of conduit 30. Each of the capacities 37 and 38 communicates permanently via two holes 39 and 40 with two conduits 41 and 42 made in the main body 17 so as to be connected respectively, externally to said body to a discharge pipe 43 (FIG. 1) returning directly to reservoir 1, and to issue into well A.

The supply circuit for unit $U_1$ such as above described and fitted according to the invention operates as follows:

When the installation is put into operation, the hydraulic accumulator 28 is empty and consequently the pressurized hydraulic fluid supplied by pump 2 is discharged inside chamber 18*b*. Piston 20 is pushed back against the action of the resilient member 24, so that vents 25 are brought to coincide with counterboring 26. The pressurized hydraulic fluid then flows through the skirt 21, counterboring 26, well D and supply conduit 5 in the direction of the electric distributor 7. This phase of operation corresponds to the loading phase of the hydraulic accumulator 28. During said phase, part of the pressurized hydraulic fluid also flows through drilling 29, and conduit 30 from which it can flow inside chamber 18*a* via restrainer 33 and valve 34. The hydraulic fluid is brought by conduit 30 in the direction of capacity 37 of the relief valve 36 but has no effect on the latter which is maintained applied against its seat in a closed position by the effect of spring 36*a* and by the pressurized fluid brought into capacity 38 by conduit 42.

Following the above described accumulator loading phase, the pressurized fluid is supplied to jack 10 by distributor 7. Considering the work position of distributor 7 shown in the drawing, the hydraulic fluid flows through valve 15 and branch circuit 14 and feeds chamber 10*a* of jack 10 whose piston rod 11 effects a rapid return stroke.

In a subsequent phase of operation, i.e. after moving the slide-valve of distributor 7 in the direction of arrow $f_1$, the pressurized hydraulic fluid flows through conduit 9 into chamber 10*b* and controls the extension stroke of the piston rod 11 corresponding to an active working stroke of the tool it carries. The hydraulic fluid discharged from chamber 10 necessarily flows through diaphragm 13, the braking effect of which confers a slow and steady advance speed to the tool carried by the piston rod 11.

If, in this last phase of operation corresponding for example to the machining operation of the tool, one of the units $U_2$ or $U_3$ effects the stroke of its cycle corresponding to a rapid return as previously described for unit $U_1$, a sudden drop of pressure occurs in the delivery circuit 3. The action of spring 24 then becomes preponderant and pushes back piston 20 in its position of abutment in which skirt 21 interrupts any communication between well A and counterboring 26. Furthermore, the action of spring 24 is completed by the pressure restituted by accumulator 28 in the chamber 18*a* by drilling 29, conduit 30 and no-return valve 34. On the other hand, this sudden drop of pressure has no effect on the position of the relief valve 36, since the sum of the fluid pressure in the well A and spring 36*a* is always greater than the pressure of the fluid restituted by accumulator 28. After piston 20 is closed, the accumulator 28 continues to feed in a normal manner the work unit $U_1$ by delivering the pressurized fluid previously accumulated in the work chamber 10*a* via distributor 7. The operation of unit $U_1$ and in particular the slow machining speed of the tool may thus continue regularly, without any disturbance as a result of the pressure drop due to the rapid return of the work tool on one of units $U_2$ and $U_3$.

When the fluid pressure delivered in the discharge circuit 3 takes back its normal value, the piston 20 is pushed back against the action of spring 24 towards the position of opening in which communication is ensured between well A and counterboring 26. The return of piston 20 to the opened position is however effected slowly since the delivery of the hydraulic fluid filling chamber 18*a* is slowed down by restrainer 33. In this manner, communication between wells A and D, i.e. restoration of supply circuit $5_1$ is effected progressively without any rush occurring in the advance and work stroke of the tool actuated by rod 11.

The above-described operation may take place, simultaneously or not, for other units, without causing any disturbance, since each supply circuit 5 suitable for a unit is controlled by a control unit in accordance with the invention. It is therefore possible to submit the various tools performing a machining operation to a perfectly controlled and regular slow advance motion which is not subject to any interference as a result of the work cycles of the units supplied in parallel from a common hydraulic station.

Another advantage of the invention resides in the fact that the control unit is designed so as to comply with the safety requirements in case of a deliberate interruption in the operation of the machine. Indeed, in such a case, an interruption in the operation of pump 2 results in a drop of pressure in the delivery circuit 3 so that spring 24 pushes back piston 20 inside cylinder 18 in the closed position illustrated by FIG. 2. The pressure also drops in the capacity 38 of the relief valve 36 which is then urged against the resilient member 36*a* by the pressure still prevailing in conduit 30 because of the restitution by accumulator 28. The opening of relief valve 36 therefore puts into communication conduits 30 and 41 so that the accumulator 28 can be emptied completely in reservoir 1 by conduit 43.

In addition to the above advantages, it is worthy of noting that the control unit according to the invention can be very easily mounted on the existing circuits, since it is only necessary to branch it on the same supply circuit 5 and to provide additionally a feed-back circuit to the reservoir from relief valve 36. Consequently, the control unit can be mounted in a rapid and easy manner, avoiding all risks of inversion or errors in the connection.

An additional advantage of the subject of the invention is due to the fact that, since it consists of two separable distinct blocks, the operations of execution, manufacture and machining as well as repairs, inspection or restoration are made easier, a total accessibility being offered to all the mobile constitutive parts.

The invention is not limited to the embodiments described and represented hereinbefore and various modifications can be made thereto without passing beyond the scope of the invention.

What is claimed is:

1. In an arrangement having a plurality of hydraulically operable work units fed from a common hydraulic pressure source through parallel supply conduits, the improvement comprising:

a control unit in the supply conduit of at least one of said work units, there being a fluid distributor and a pressure accumulator between said control unit and said one work unit;

said control unit comprising a block defining a cylinder having an inlet form and an outlet to said supply conduit, said cylinder having an obturator therein urged by resilient means to a position in which it closes communication between said inlet and outlet, said resilient means being in a portion of said cylinder comprising a first chamber defined in part by said obturator;

a relief valve in said block and a second conduit means communicating with said chamber, said outlet and said relief valve; and opposite sides of said relief valve communicating with further conduits leading, respectively, to a return tank and to said inlet, said further conduit leading to said inlet being arranged so that pressure in said inlet tends to close said relief valve, said relief valve, when open, providing communication between said outlet and said return tank.

2. A control unit as defined in claim 1 wherein said obturator is a piston dividing said cylinder into said first chamber and a second chamber, both of variable volume, said piston having axially extending skirts, an annular channel in said cylinder communicating with said outlet and communicating with said second chamber in one position of said piston.

3. A control unit as defined in claim 2 including openings in a skirt of said piston, said openings registering with said channel when said piston is in said one position.

4. A control unit as defined in claim 1 wherein said second conduit means includes a flow restrictor and one-way valve between said first chamber and said relief valve.

5. A control unit as defined in claim 1, wherein said relief valve has a moveable member in a third chamber dividing said chamber into two variable volumes, one of which communicates with said inlet and which houses a spring urging said moveable member in a direction to close said second conduit means from said return tank.

* * * * *